US008618995B2

(12) United States Patent
Yamagajo et al.

(10) Patent No.: US 8,618,995 B2
(45) Date of Patent: Dec. 31, 2013

(54) METAL PIPE MANAGED BY WIRELESS TAG AND WIRELESS TAG

(75) Inventors: Takashi Yamagajo, Kawasaki (JP); Toru Maniwa, Kawasaki (JP); Manabu Kai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 128 days.

(21) Appl. No.: 12/786,928

(22) Filed: May 25, 2010

(65) Prior Publication Data

US 2010/0231474 A1 Sep. 16, 2010

Related U.S. Application Data

(63) Continuation of application No. PCT/JP2007/072900, filed on Nov. 28, 2007.

(51) Int. Cl.
*H01Q 13/10* (2006.01)
*H01Q 9/16* (2006.01)

(52) U.S. Cl.
USPC ..... 343/767; 343/770; 343/806

(58) Field of Classification Search
USPC ..... 343/767
See application file for complete search history.

(56) References Cited

U.S. PATENT DOCUMENTS 2,622,199 A * 12/1952 Ramsay et al. ..... 343/771
5,131,409 A * 7/1992 Lobarev et al. ..... 607/156
2002/0133942 A1 9/2002 Kenison et al.
2005/0189679 A1 9/2005 Kenison et al.
2006/0023575 A1* 2/2006 Hayashi et al. ..... 369/30.37
2006/0208955 A1* 9/2006 Kai et al. ..... 343/795

FOREIGN PATENT DOCUMENTS

| | | | |
|---|---|---|---|
| DE | 19646994 | A1 | 5/1998 |
| EP | 1901393 | A1 | 3/2008 |
| JP | 2001357366 | | 12/2001 |
| JP | 2003017514 | | 1/2003 |
| JP | 2006039967 | | 2/2006 |
| JP | 2006352370 | | 12/2006 |
| JP | 2007135183 | | 5/2007 |
| KR | 100741474 | B1 | 7/2007 |
| TW | 200727530 | A | 7/2007 |
| WO | 2006120996 | A1 | 11/2006 |

OTHER PUBLICATIONS

"Time Changing Electric and Magnetic Fields," Electromagnetics, Second Edition, Kraus et al, 1973, pp. 305-324.*
International Preliminary Report on Patentability dated Jun. 17, 2010 received in PCT/JP2007/072900.

(Continued)

*Primary Examiner* — Jacob Y Choi
*Assistant Examiner* — Graham Smith
(74) *Attorney, Agent, or Firm* — Smith, Gambrell & Russell, LLP

(57) ABSTRACT

A metal pipe includes a slot having a predetermined length in a longitudinal direction of the metal pipe and a wireless tag that is placed inside the metal pipe and includes a power feeding unit to feed electric power to the slot and an IC chip connected to the power feeding unit, thereby functioning as an antenna of the wireless tag. The metal pipe is thus managed by the wireless tag.

10 Claims, 16 Drawing Sheets

(56) References Cited

OTHER PUBLICATIONS

Extended European Search Report dated Oct. 25, 2010 received in corresponding European Patent Application No. 07832622.0-1248/2226746 PCT/JP2007072900.

Taiwan Office Letter dated Apr. 22, 2011 for application No. 096145239.

John D. Kraus, Antennas 3rd Edition, McGraw Hill Science/Engineering/Math; pp. 321-322 dated Nov. 12, 2001.

International Search Report dated Feb. 12, 2008 in corresponding International application No. PCT/JP2007/072900.

Notice of Preliminary Rejection mailed Sep. 22, 2011 issued in the corresponding Korean Patent Application No. 10-2010-7011683.

* cited by examiner

METAL PIPE MANAGED BY WIRELESS TAG AND WIRELESS TAG

CROSS-REFERENCE TO RELATED APPLICATIONS

This is a continuation of Application PCT/JP2007/072900, filed on Nov. 28, 2007, now pending, the contents of which are herein wholly incorporated by reference.

FIELD

The present invention relates to a technology for managing a metal pipe by a wireless tag.

BACKGROUND

Over the recent years, a management system for conducting inventory management and physical distribution management of products, parts, etc has involved utilizing a RFID (Radio Frequency Identification) technology. In the system using this RFID technology, wireless communications are performed between the wireless tag and a reader/writer (which will hereinafter be simply referred to as an interrogator), and the interrogator reads identifying information etc stored in the wireless tag. The wireless tag is also called a RFID tag, an IC (Integrated Circuit) tag, etc.

In the following patent document 1, a system which manages a multiplicity of stacked discs such as CDs and DVDs is proposed as the management system using the RFID technology described above. In this management system, the IC tag is attached to the disc, and the interrogator is connected to a holder inserted into a central hole of the disc. Further, this document discloses that the holder is configured as a slot antenna by having a hollow pipe shape and forming a slot elongated in a longitudinal direction of a hollow pipe.

Further, the following Non-Patent document 1 proposes a technology related to a slot cylinder antenna.

[Patent document 1] Japanese Patent Laid-Open Publication No. 2006-39967

[Non-Patent document 1] John D. Kraus Antennas 3rd Edition McGraw-Hill Science/Engineering/Math, Nov. 12, 2001, pp 321-322

SUMMARY

In the management system using the RFID technology as described above, in the case of managing the metal pipe utilized as a construction material etc, for instance, the following problems arise.

At first, a problem arises with respect to a position in which the wireless tag is attached to the management target metal pipe. In the case of attaching the wireless tag to the external surface of the metal pipe, there is a high possibility of damaging the wireless tag due to the way of handling the metal pipe. As viewed from an environmental aspect of dealing with the metal pipe, in the case of the attaching the wireless tag to the outside of the metal pipe, a water drop, dirt, etc are adhered to the periphery of the tag antenna, with the result that antenna characteristics of the wireless tag are deteriorated and an abnormal state occurs in the communications between the wireless tag and the interrogator.

On the other hand, in the case of attaching the wireless tag to the inside of the metal pipe, radio waves transmitted and received between the wireless tag and the interrogator are not propagated within the metal pipe due to a cutoff frequency. Supposing that the metal pipe is deemed as a circular waveguide and a radius of the metal pipe is set to 0.025 (meter (m)), a wavelength of the radio wave becomes 0.085 (m), and the cutoff frequency comes to 3.5 (gigahertz (GHz)). Herein, a 2.45 GHz band, and a UHF band (ranging from 860 megahertz (MHz) to 960 MHz) are specified as usage frequency bands for the wireless tag utilizing electromagnetic waves. Note that a frequency band from 952 MHz to 954 MHz is specified in Japan as the UHF band. From this point, the frequency utilized for the wireless tag is lower than the cutoff frequency, and it is therefore understood that the radio waves are not propagated within the metal pipe.

It is an object of the present invention to provide a technology of managing the metal pipe by use of the wireless tag.

The present invention adopts the following configurations in order to solve the problems given above. Namely, a first mode of the present invention is related to a metal pipe which is formed with a slot having a predetermined length in a longitudinal direction and includes a wireless tag which is placed inside thereof and includes a power feeding unit to feed electric power to the slot and an IC (Integrated Circuit) chip connected to this power feeding unit.

The metal pipe according to the first mode has this structure, thereby functioning as an antenna of the wireless tag attached to the inside thereof. With this contrivance, according to the first mode, also in the structure of attaching the wireless tag to the inside of the metal pipe, radio waves can be transmitted to an interrogator via the metal pipe from the wireless tag, and the radio waves can be received by the wireless tag via the metal pipe from the interrogator.

This configuration enables the wireless tag to perform wireless communications with the external interrogator, and identifying information for identifying the metal pipe is transmitted to the interrogator from the wireless tag attached to the metal pipe. As a result, according to the first mode, the metal pipe can be managed by use of the wireless tag.

In the first mode described above, preferably, the power feeding unit includes a conductor pattern which forms a dipole and further has a matching function of taking impedance matching between the metal pipe and the IC chip by adjusting a length of the conductor pattern.

According to this mode, the power feeding unit feeds the electric power to the slot of the metal pipe functioning as the antenna, and further takes the impedance matching between the IC chip connecting with the power feeding unit and the antenna. With this configuration, the electric power can be effectively transferred and received between the metal pipe functioning as the antenna and the IC chip connected to this power feeding unit.

Further, in the first mode, preferably, the wireless tag further includes a matching unit which includes a looped conductor pattern connected to the IC chip in parallel and takes impedance matching between the metal pipe and the IC chip with the looped conductor pattern.

According to this mode, even in a mode where the power feeding unit has none of the matching function, this matching unit adjusts, e.g., a shape of the looped conductor pattern, thereby changing inductance and taking the impedance matching between the metal pipe and the IC chip. In the mode where the power feeding unit has the matching function, it is possible to take the matching about a portion that can not be completely compensated by the matching function of the power feeding unit.

This configuration enables the electric power to be effectively transferred and received between the metal pipe functioning as the antenna and the IC chip connecting with the power feeding unit.

Yet further, in the first mode, preferably, the wireless tag further includes an insulating member which seals the slot formed in the metal pipe.

According to the mode described above, without deteriorating the antenna characteristics of the metal pipe, it is further feasible to prevent intrusion, from the outside, of substances such as the water drop and dirt that can cause a damage to the wireless tag or cause a decline of a communication quality of the wireless tag.

In order to obtain a further similar effect, in the first mode, preferably, the wireless tag may be attached to the inside in a state of being covered by an insulating element.

Yet further, as in the first mode, on the occasion of making the metal pipe function as the antenna of the wireless tag, preferably, in order to ensure a gain of the metal pipe serving as the antenna, a length of the slot formed in the metal pipe in the longitudinal direction thereof, a height from the floor surface and a distance between the slots of neighboring metal pipes, are each properly determined.

With this contrivance, the wireless communications between the wireless tag attached to the metal pipe and the external interrogator can be performed with the highly-acceptable quality, and hence the metal pipe can be managed by using the wireless tag. Moreover, the contrivance described above leads to extending a communication-enabled distance between the wireless tag attached to the metal pipe and the external interrogator, thereby facilitating the configuration of the system for managing the metal pipe.

It should be noted that another mode according to the present invention may be a wireless tag having any functions described above, may also be a metal pipe having any functions described above, and may further be a metal pipe management method using the wireless tag.

According to the present invention, it is feasible to realize the technology of managing the metal pipe by use of the wireless tag.

DESCRIPTION OF EMBODIMENTS

A metal pipe with a wireless tag will hereinafter be described by way of an embodiment of the present invention with reference to the drawings. It should be noted that a configuration in the embodiment which will hereinafter be discussed is an exemplification, and the present invention is not limited to the configuration in the embodiment.

[Structure]

Figure 1:
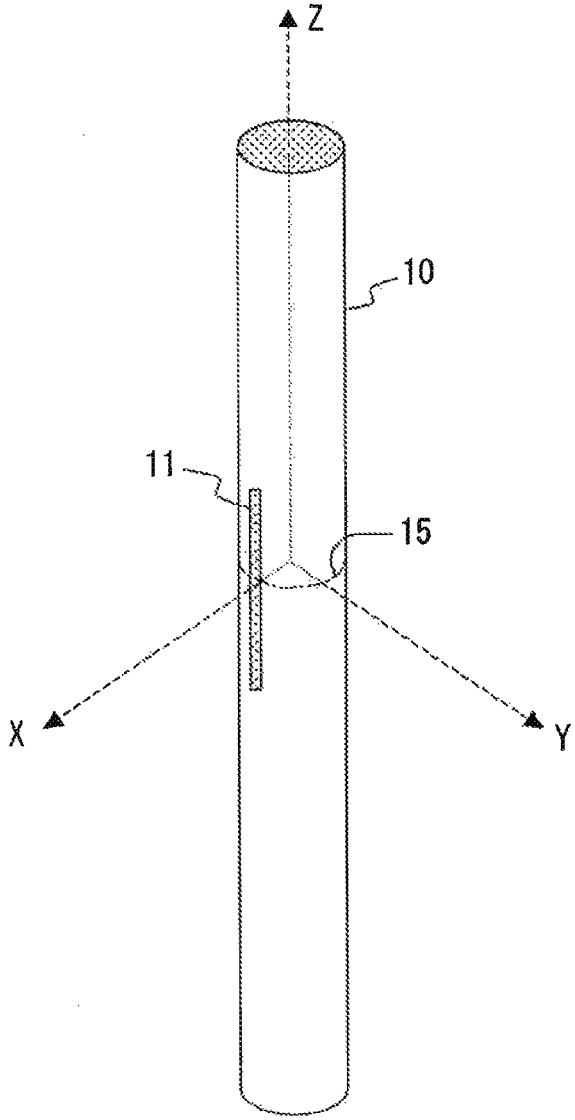
FIG. 1 is a perspective view depicting a structure of a metal pipe by way of an embodiment of the present invention.

A structure of a metal pipe will hereinafter be described with reference to FIGS. 1 and 2 as an embodiment of the present invention. FIG. 1 is a perspective view illustrating a structure of the metal pipe as the embodiment of the present invention. In FIG. 1, for explanatory convenience's sake, respective coordinates on an X-axis, a Y-axis and a Z-axis are depicted by broken lines.

As illustrated in FIG. 1, a metal pipe 10 as the embodiment of the present invention is formed with a slot 11 having a predetermined length in a longitudinal direction (in the direction of the Z-axis in FIG. 1). The slot 11 functions as a slot antenna for the wireless tag attached to the inside of the metal pipe 10. A detailed operation principle of the cylindrical antenna with the slot is as disclosed in Non-Patent document 1 given above. The slot 11 is, for example, formed so as to have a length on the order of 18 centimeters (cm) in the longitudinal direction and a width on the order of 2 millimeters (mm).

Figure 2:
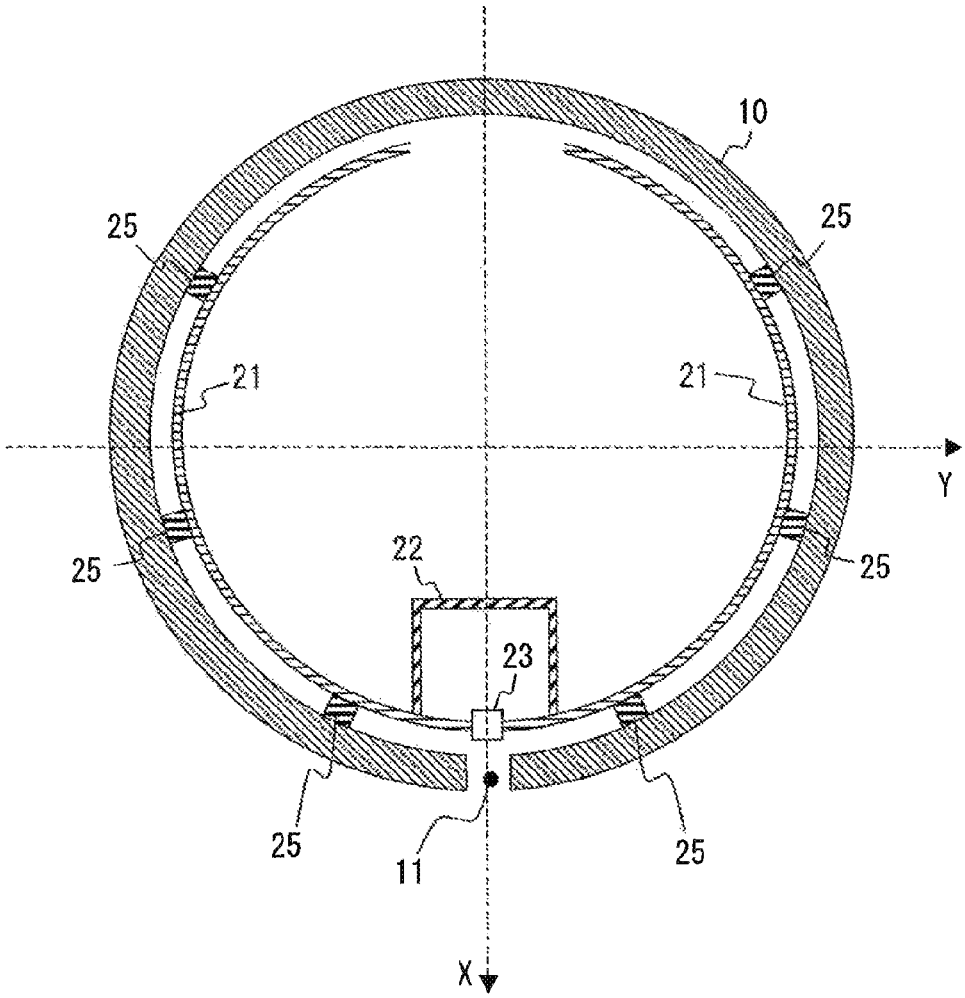
FIG. 2 is a sectional view of a metal pipe 10 illustrated in FIG. 1 as viewed from the top of a Z-axis in the case of cutting the metal pipe by an X-Y plane.

FIG. 2 is a sectional view of the metal pipe 10 illustrated in FIG. 1 as viewed from the top of the X-axis in the case of cutting the metal pipe 10 by an X-Y plane. A long chain line 15 in FIG. 1 represents a cutting line when cut by the X-Y plane.

As depicted in FIG. 2, inside the metal pipe 10 given by way of the embodiment of the present invention, the wireless tag storing identifying information for identifying this metal pipe is attached. With this scheme, the metal pipe 10 is identified in such a way that a predetermined interrogator (unillustrated) reads the identifying information stored in the wireless tag, thus is managed. Note that FIGS. 1 and 2 each illustrate the example of the metal pipe 10 taking the cylindrical shape by way of the embodiment, however, the metal pipe 10 may also be formed in a shape having a square section.

The wireless tag attached to the metal pipe 10 includes conductor patterns 21, 22 and an IC chip 23.

The conductor pattern 21 has a substantially C-like shape and is composed of a power feed element. The conductor pattern 21 is connected to the IC chip 23 at a substantially central point (feeding point) and configures a dipole taking a curvilinear shape. In the example of FIG. 2, the conductor pattern 21 takes an arc shape along an inner periphery of the metal pipe 10 and is formed in, e.g., a linear shape having a width of 1 millimeter (mm). The present invention does not, however, limit the conductor pattern 21 to this shape, and the conductor pattern 21 may be configured to have a curved-surface. Moreover, the conductor pattern 21 is not, when configured in a curved line, limited to the case of being formed in parallel with the X-Y plane orthogonal to the longitudinal direction (Z-axis) of the metal pipe.

The conductor pattern 21 is fixed to the metal pipe 10 by an insulating member 25 such as a resin. Owing to this construction, the conductor pattern 21 and the metal pipe 10 are insulated from each other. It should be noted that the present invention does not restrict a method of how the wireless tag including this conductor pattern 21 is attached to the inside of the metal pipe 10, and it is enough that the conductor pattern 21 is fitted to the metal pipe 10 in the insulating state.

The conductor pattern 21 functions as a power feeding circuit which feeds the power to the slot 11 (slot antenna) of the metal pipe 10. The conductor pattern 21 is, as described above, isolated from the metal pipe 10 and therefore feeds the power to the slot 11 through electromagnetic coupling. Accordingly, the conductor pattern 21 may take whatever configuration if capable of functioning as the power feeding circuit and formed in the shape enabling the conductor pattern itself to be electromagnetically coupled to the slot 11. Moreover, it is preferable that the length of the conductor pattern 21 is shorter than a half-wave length of the frequency utilized for the communications between the wireless tag and the interrogator.

The conductor pattern 21 functions as the power feeding circuit as described above and also functions as a matching circuit in cooperation with the conductor pattern 22. This point will be described later on.

The conductor pattern 22 is composed of the power feed element in a loop-shape and is connected to the IC chip 23 in parallel. This conductor pattern 22 functions as, in cooperation with the conductor pattern 21 described above, the matching circuit which adjusts impedance between the metal pipe 10 operating as the antenna and the IC chip 23.

The conductor pattern 22 functions as a coil in terms of its configuration and can change inductance corresponding to a size of its outer periphery (a size of the loop). Further, also in the conductor pattern 21 having the dipole shape, the impedance changes corresponding to the length thereof. Accordingly, corresponding to a characteristic of the IC chip 23 to be adopted, and a material and the shape of the management target metal pipe 10, the length of the conductor pattern 21 and the shape (the size of the loop) of the conductor pattern 22 are determined in a way that matches the IC chip 23 and the metal pipe 10 with each other. The conductor pattern 22 has the linear shape having the width 1 mm and is formed to have a loop that is 6 mm in height (the X-axis direction) and 7.4 mm in width (the Y-axis direction).

Note that the loop of the looped conductor pattern 22 is formed to have a size smaller than the size of the C-shaped outer periphery of the C-shaped conductor pattern 21 in the example of the embodiment illustrated in FIG. 2, and hence the discussion herein does not touch that this conductor pattern 22 functions as the power feeding circuit. The conductor pattern 22 may, however, be configured to function as the power feeding circuit as well as functioning as the matching circuit (refer to the paragraph [Modified Example]).

The IC chip 23 is a tag LSI (Large Scale Integration) which includes a CPU (Central Processing Unit) function, a memory etc and provides the function as the wireless tag. To be specific, the IC chip 23, through operations of, e.g., a wireless processing unit, a modulation processing unit, a demodulation processing unit, etc, performs the wireless communications with the interrogator. The IC chip 23 stores the identifying information for identifying each metal pipe in the memory, and transmits and receives this identifying information to and from the interrogator through the wireless communications. Herein, in the case of performing the wireless communications via the electromagnetic waves, the IC chip 23 conducts the communications by use of a frequency of 2.45 GHz band or a UHF band.

The IC chip 23 is constructed as a passive tag which operates in a way that uses, as an energy source, the radio waves transmitted from the interrogator. The IC chip 23 may also be constructed as an active tag which uses the internal power source as the energy source. The present invention does not restrict the function of this IC chip 23, and the IC chip 23 is sufficient if having the function of the general type of wireless tag. The IC chip 23 utilizes the conductor pattern 21 as the power feeding circuit and further the slot 11 of the metal pipe 10 as the antenna, thereby executing the wireless communications with the interrogator.

Note that the IC chip 23 is disposed inwardly on the X-axis where the slot 11 exists in the example of FIG. 2, however, the IC chip 23 may be, if connected to the conductor pattern 21 at the substantially central point, disposed in whichever position without depending on the position of the slot 11 of the metal pipe 10.

[Operation and Effect]

An operation and an effect of the metal pipe with the wireless tag given by way of the embodiment discussed above, will be described.

The metal pipe 10 given by way of the embodiment has the wireless tag attached inside and is managed in such a manner that the external interrogator reads the identifying information etc stored in the IC chip 23 of this wireless tag. The wireless tag management system including this interrogator conducts inventory management and physical distribution management of the metal pipes by identifying the respective metal pipes with the identifying information read from the wireless tags of the metal pipes. In this physical distribution management, information indicating which position of a building each metal pipe is installed in may be managed.

According to the embodiment, the wireless tag is attached to the inside of the metal pipe 10, and it is therefore feasible to reduce a possibility of causing a damage to the wireless tag. Further, a water drop and dirt can be prevented from adhering to the wireless tag.

Moreover, in the metal pipe 10 given by way of the embodiment, the slot 11 formed so as to have the predetermined length in the longitudinal direction is utilized as the antenna for the wireless tag attached to the inside thereof. With this contrivance, the identifying information for identifying the metal pipe 10, to which the wireless tag is attached, is transmitted from the slot antenna.

This configuration enables, also in the arrangement of attaching the wireless tag to the inside of the metal pipe 10, the radio waves to be properly transmitted to the interrogator from this wireless tag and the radio waves from the interrogator to be received by the wireless tag.

In the embodiment, the wireless tag includes the power feeding circuit in order to utilize, as the antenna, the slot 11 of the metal pipe 10. Specifically, the conductor pattern 21 building up the wireless tag functions as the power feeding circuit. The conductor pattern 21 is fixed to the metal pipe 10 via the insulating member 25 in the insulating state, and feeds the power to the slot 11 through the electromagnetic coupling.

Moreover, in order that the slot antenna and the IC chip 23 of the metal pipe 10 can effectively transfer and receive the electric power, the wireless tag has the looped conductor pattern 22 serving as the matching circuit. The looped conductor pattern 22 is connected to the IC chip 23 in parallel, and takes impedance matching between the slot antenna and the IC chip 23 of the metal pipe 10.

FIGS. 3 through 6 are diagrams each illustrating a communication characteristic of the metal pipe 10 to which the wireless tag by way of the embodiment is attached. The effect of the embodiment will hereinafter be demonstrated with reference to FIGS. 3 through 6. FIGS. 3 through 6 illustrate results of simulations by exemplifying the case where the metal pipe 10 is 1 meter (m) in length and 5 centimeters (cm) in diameter of the section, the slot is 18 cm in length and 2 millimeters (mm) in width, and the wireless tag includes the linear conductor pattern 21 having the width of 1 mm and the conductor pattern 22 taking the same linear shape as that of the conductor pattern 21 and formed with the loop having the height of 6 mm and the width of 7.4 mm.

Figure 3:
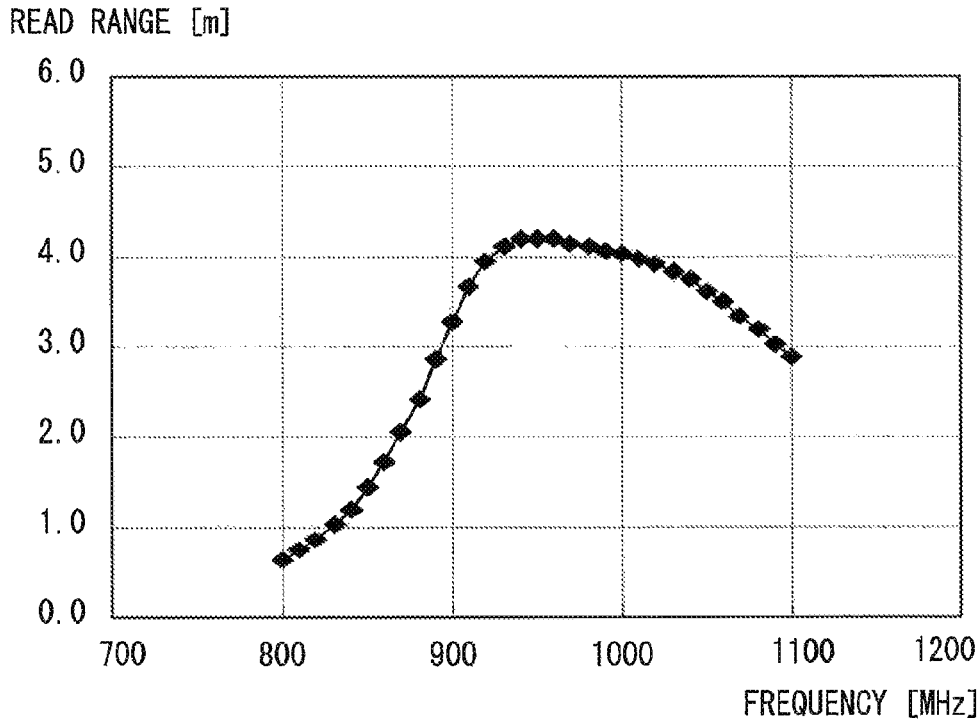
FIG. 3 is a graph representing a result of simulating a relation between a communication-enabled distance and a usage frequency band in the metal pipe with the wireless tag by way of the embodiment.

FIG. 3 illustrates the result of simulating a relation between a communication-enabled distance and a usage frequency band in the case of performing the wireless communications between the interrogator having an antenna gain of 8 (dBi), transmission power of 27 (dBm) and a cable loss of −1.3 (dB) and the wireless tag in such a case that the IC chip 23 is constructed so that the resistance on the order of approximately 1.4 (pF) is connected to the impedance on the order of approximately 400 ohms in parallel. Incidentally, at this time, if capable of receiving the power of −9 (dBm), it is determined that the radio waves can be received.

As illustrated in FIG. 3, according to the structure in the embodiment, the longest communication distance can be actualized in the frequency band (ranging from 952 MHz to 954 MHz) specified in Japan in the UHF band (from 860 MHz to 960 MHz) as the frequency band utilized for the wireless tag. If a distance from 2 meters to 4 meters can be taken as the communication distance, the wireless tag management system for managing the metal pipe can be realized without any problems.

Figure 4:
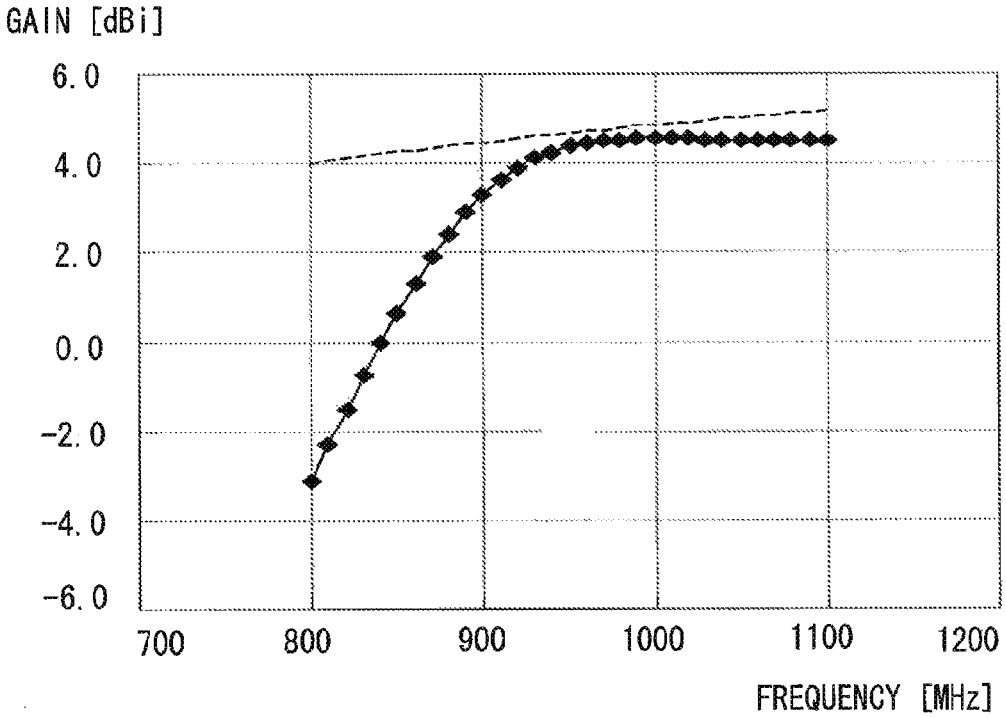
FIG. 4 is a graph representing a result of simulating a relation between an antenna gain and the usage frequency band in the metal pipe with the wireless tag by way of the embodiment.

FIG. 4 illustrates a result of simulating a relation between the antenna gain of the metal pipe 10 and the usage frequency band in a case where the wireless tag and the interrogator have the configurations depicted in FIG. 3, and further it is assumed that electric conductivity of the metal pipe 10 is on the order of $5\times10^6$ (siemens per meter (S/m)) and a thickness thereof is 18 micrometers (μm). A broken line depicted in FIG. 4 represents the result assuming the metal pipe 10 is a perfect conductor (PEC).

As illustrated in FIG. 4, according to the structure in the embodiment, the highest gain can be obtained in the frequency band specified in Japan. Generally, the wireless tag is said to have high performance if obtaining the gain of approximately 2.5 (dBi). Accordingly, the metal pipe having the structure in the embodiment can be managed by the wireless tag management system without any problems.

Figure 5:
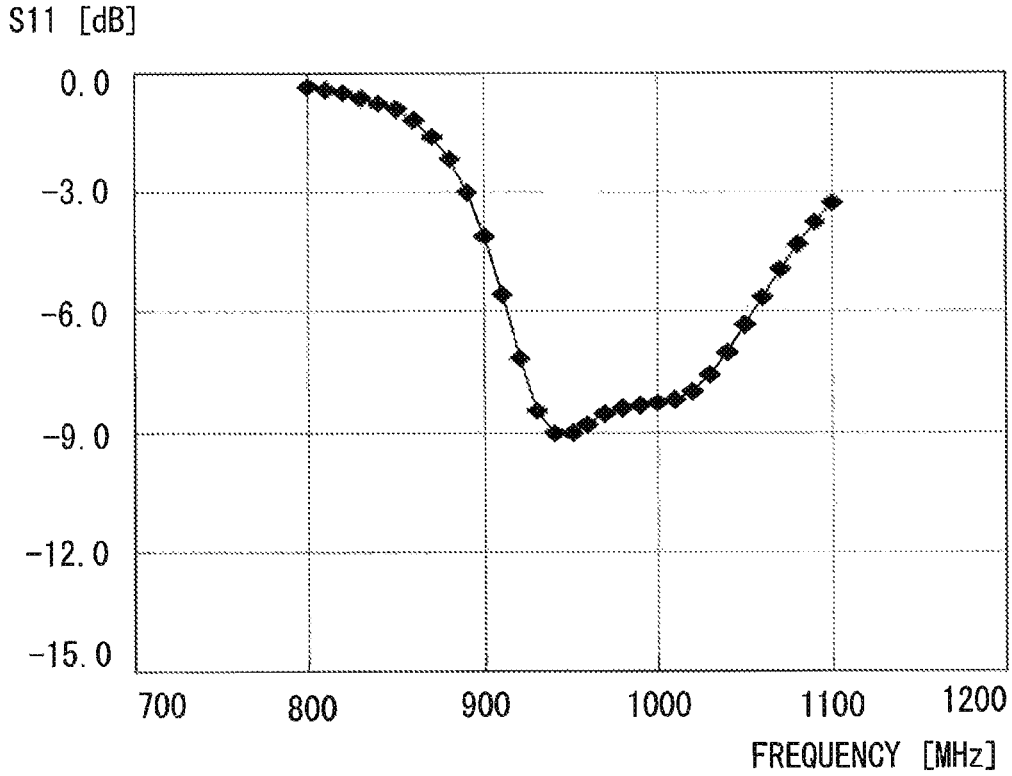
FIG. 5 is a graph representing a result of simulating a relation between a matching degree of impedance of an IC chip 23 with impedance of the metal pipe 10 serving as the antenna and the usage frequency band.

FIG. 5 illustrates a result of simulating a relation between a matching degree of the impedance of the IC chip 23 with the impedance of the metal pipe 10 serving as the antenna and the usage frequency band under the conditions in FIGS. 3 and 4. As illustrated in FIG. 5, according to the structure in the embodiment, the matching degree can be most increased in the frequency band specified in Japan.

Figure 6:
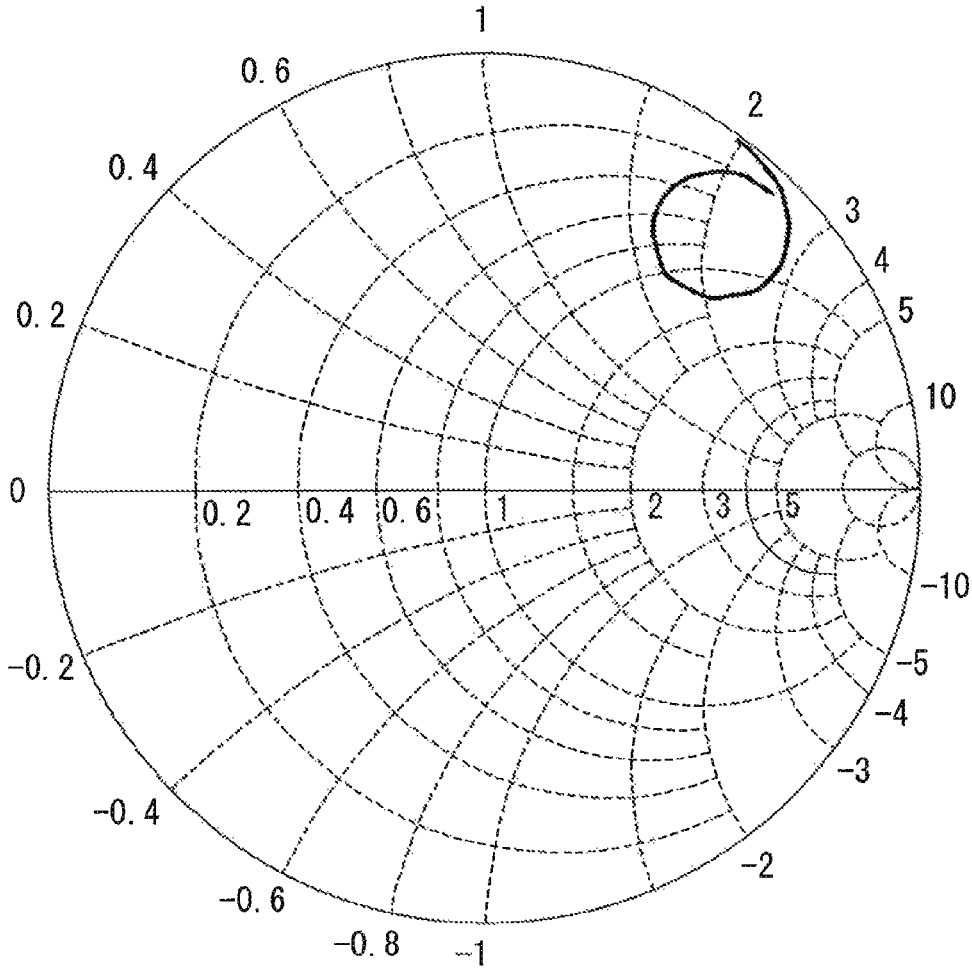
FIG. 6 is a Smith chart illustrating the impedance of the metal pipe 10 serving as the antenna.

FIG. 6 is a Smith chart illustrating the impedance of the metal pipe 10 serving as the antenna. A locus of the impedance of the slot antenna appears in the positions as depicted in FIG. 6 in the case of using the frequency band ranging from 800 (MHz) to 1100 (MHz) under the conditions in FIG. 3.

[Management Technique of Metal Pipe]

As discussed above, the use of the metal pipe 10 with the wireless tag by way of the embodiment enables the wireless tag to be properly managed by the wireless tag management system. The metal pipe 10 is, however, the management target, and hence the length thereof can not be restricted. An adjustment technique or a management technique for making the management target metal pipe function as the metal pipe 10 by way of the embodiment, will hereinafter be described.

Figure 7:
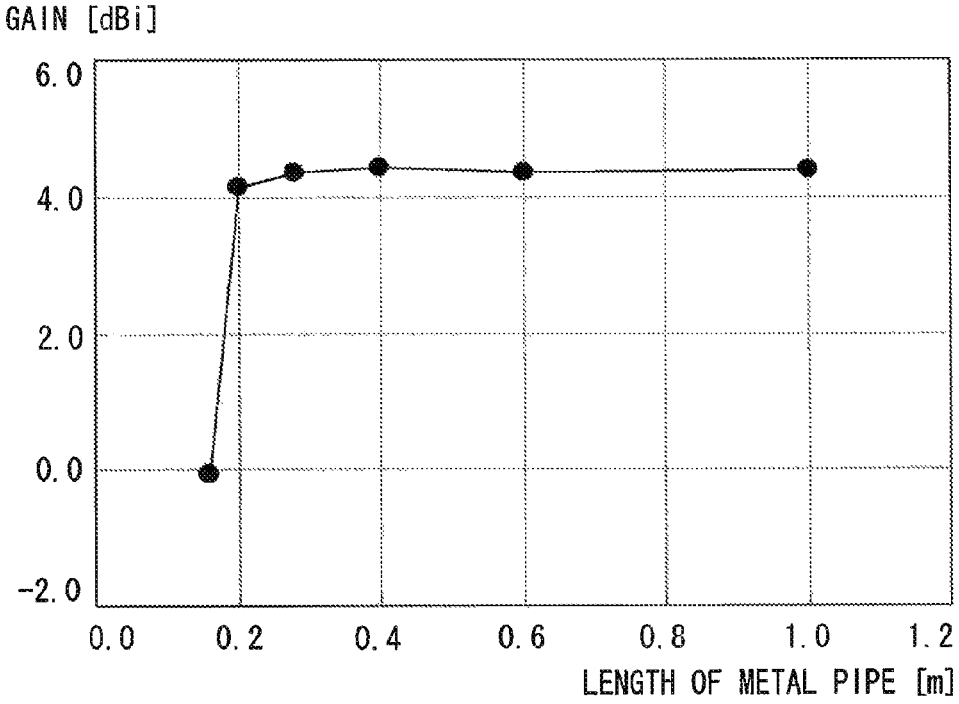
FIG. 7 is a graph illustrating a result of simulating the gain of the metal pipe 10 in the case of changing a length of the metal pipe 10.

FIG. 7 illustrates a result of simulating the gain of the metal pipe 10 in the case of changing the length of the metal pipe 10 under the conditions in FIG. 3.

As illustrated in FIG. 7, the gain is low when the length of the metal pipe 10 is the same as the slot length (18 cm) but is high with almost no change when longer than the slot length. Namely, the antenna performance of the wireless tag does not depend on the length of the metal pipe 10. Accordingly, even when managing the metal pipe by the wireless tag on the basis of the structure as in the embodiment, there is no necessity for restricting the length of the management target metal pipe. Namely, according to the structure as in the embodiment, the variety of metal pipes can be managed by the wireless tags.

Figure 8:
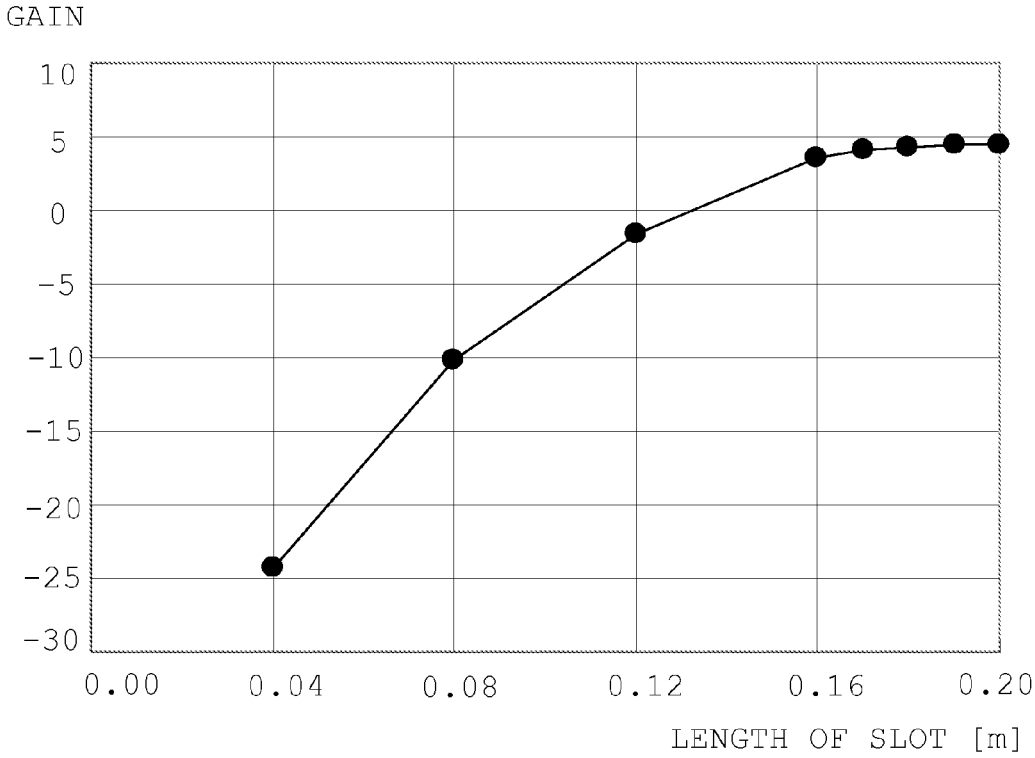
FIG. 8 is a graph representing a result of simulating a relation between a length of a slot 11 of the metal pipe 10 and a gain of the metal pipe 10.
Figure 9:
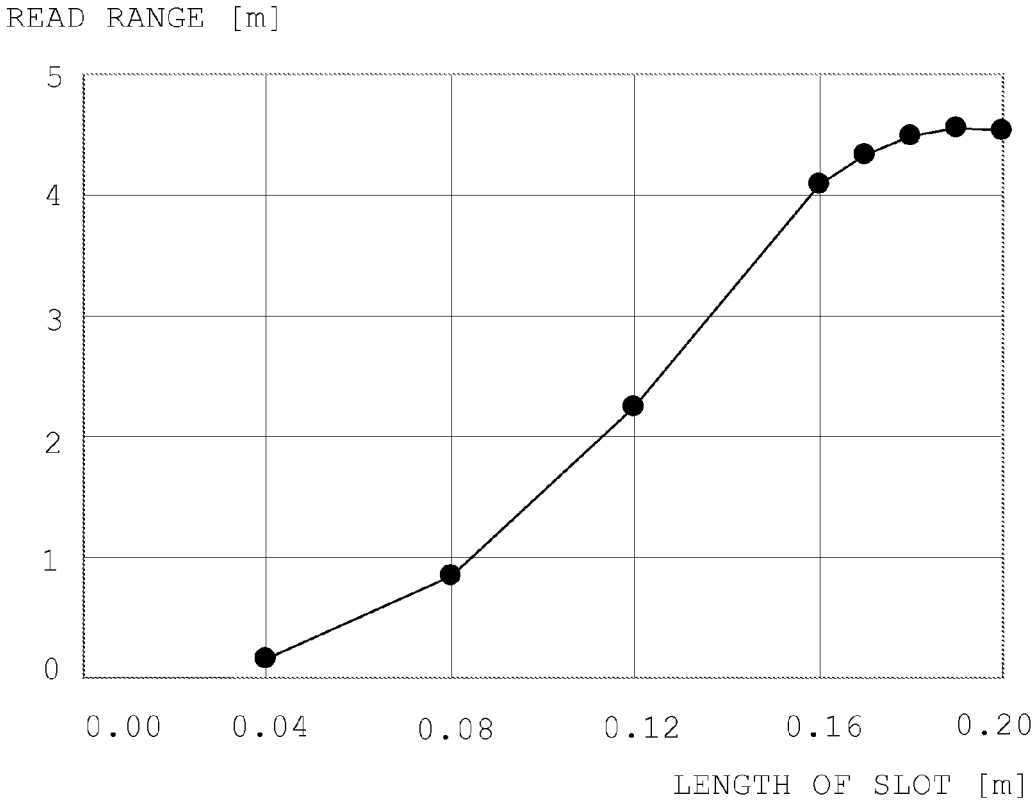
FIG. 9 is a graph representing a result of simulating the length of the slot 11 of the metal pipe 10 and a communication-enabled distance.

FIGS. 8 and 9 each illustrate a result of simulating the gain of the metal pipe 10 and the communication-enabled distance in the case of changing the length of the slot 11 of the metal pipe 10 under the conditions in FIG. 3.

As depicted in FIGS. 8 and 9, the length of the slot 11 strongly depends on the antenna performance of the wireless tag. If the length of the slot 11 is set in the 0.16 (m) to 0.20 (m) range, however, it is possible to actualize the gain of 4 (dBi) and the communication-enabled distance equal to or longer than 4 (m). Accordingly, it is sufficient to determine the required length of the slot 11 corresponding to the characteristics given in FIGS. 8 and 9 in a way that takes account of the communication distance etc required in the wireless tag management system.

Thus, the metal pipes having the variety of lengths can be managed by the wireless tags if having the structures of the metal pipe and of the wireless tag by way of the embodiment. On this occasion, the predetermined slot is formed in the management target metal pipe, and the wireless tag having the structure in the embodiment is attached thereto.

Next, the management technique of the metal pipe 10 will be described by way of the embodiment. For example, the plurality of metal pipes 10, in a state of being arranged and stored in a storehouse etc or in a state of being arranged on a belt conveyor etc on a manufacturing line, perform the wireless communications with the interrogators and are, with the identifying information being read by the interrogators, thus managed. Herein, the management technique of the metal pipe will be discussed by way of the embodiment with reference to FIGS. 10 through 12 as to which position are desirable the metal pipe 10 is disposed in to perform the communications with the interrogator in a positional relation with a floor surface.

Figure 10:
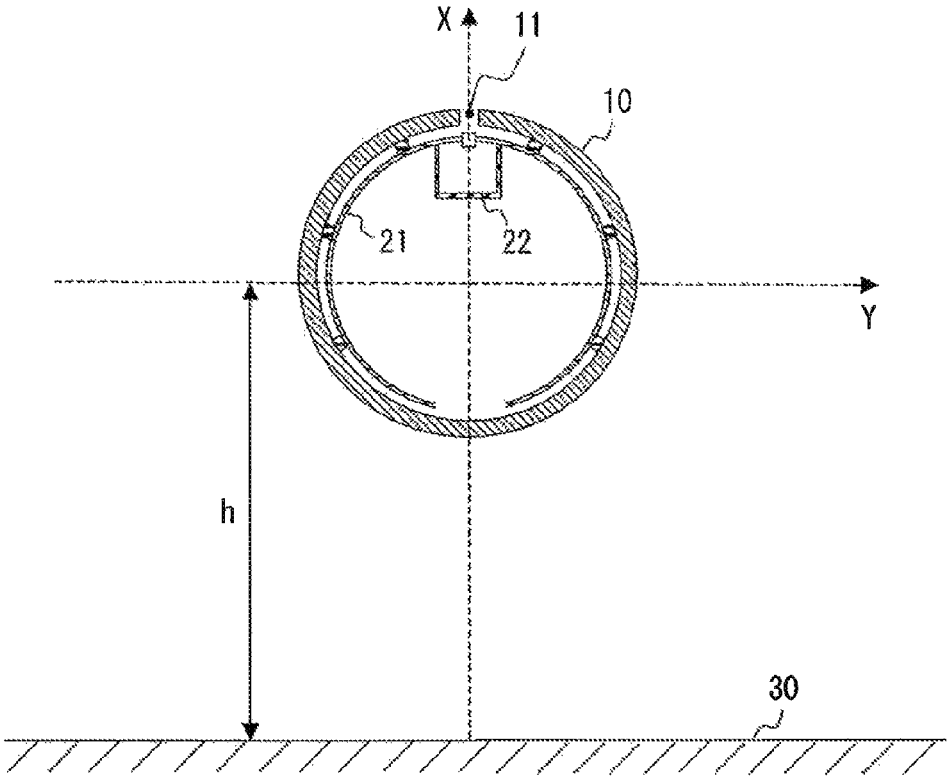
FIG. 10 is a diagram illustrating a management example of the metal pipe by way of the embodiment.
Figure 11:
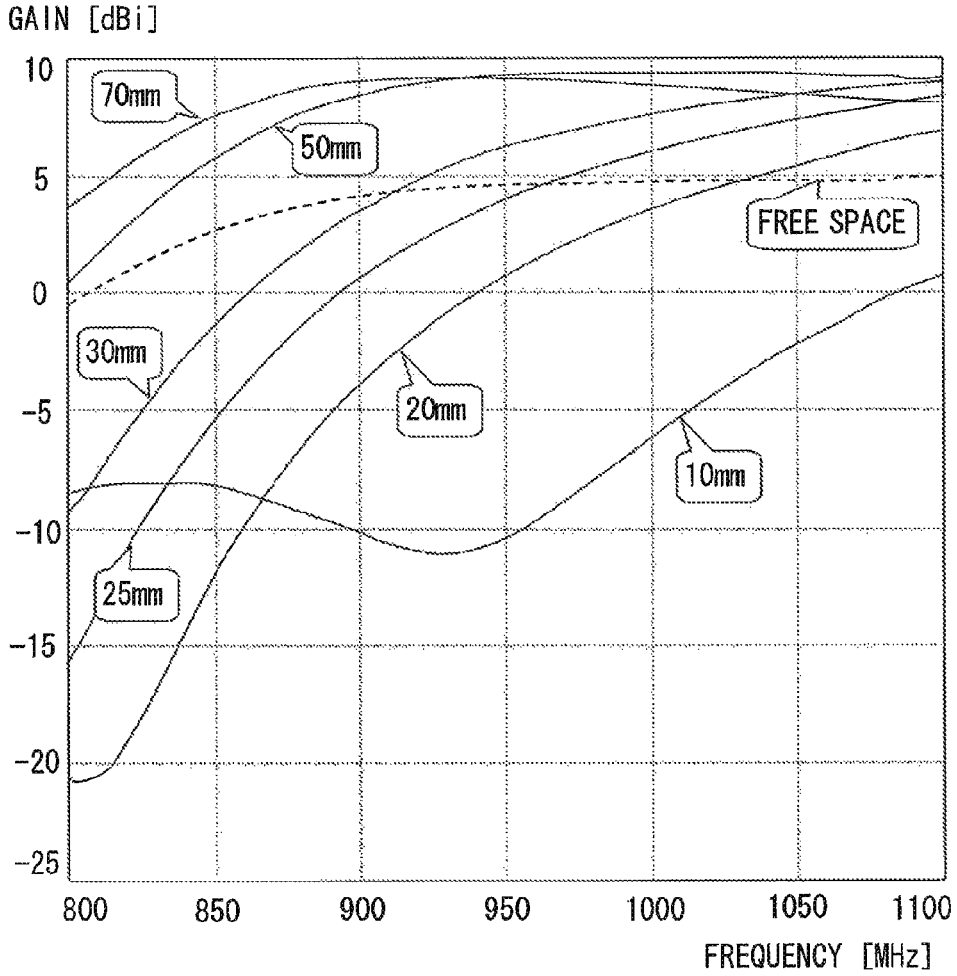
FIG. 11 is a graph representing a result of simulating a relation between the antenna gain of the metal pipe 10 and the usage frequency band, corresponding to a height of the metal pipe 10 from a floor surface in the example given in FIG. 10.
Figure 12:
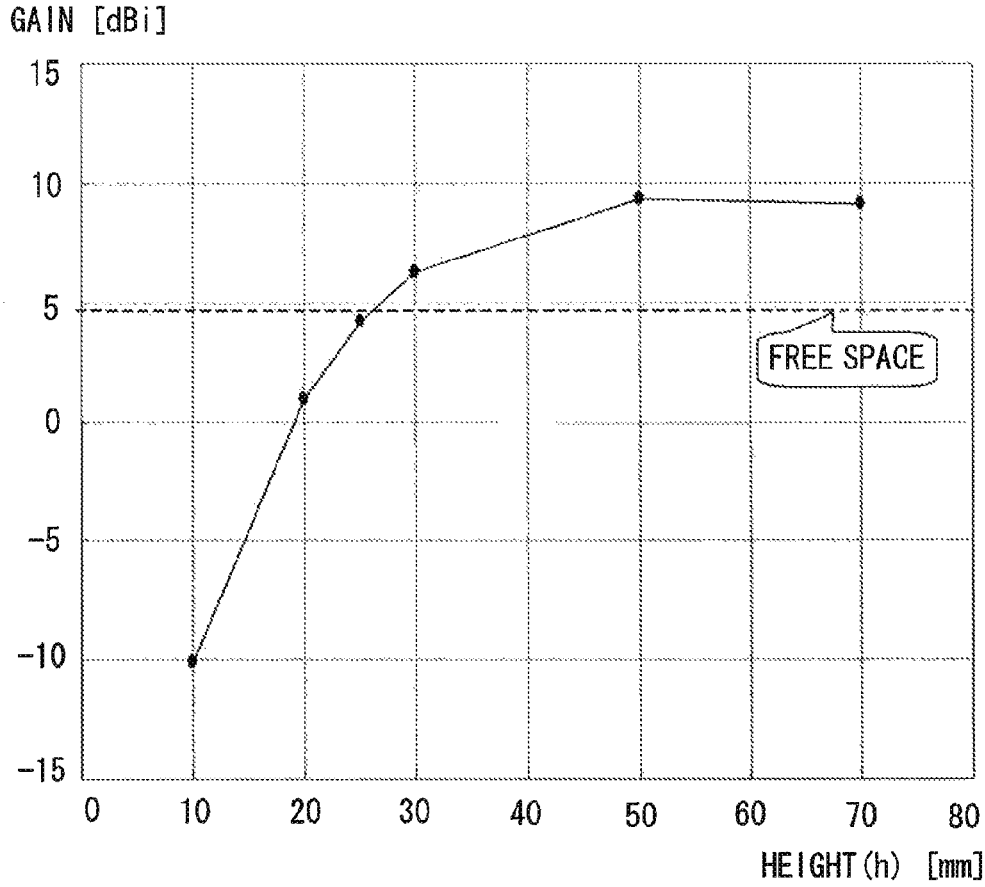
FIG. 12 is a graph representing a result of simulating a relation between the antenna gain of the metal pipe 10 and the height of the metal pipe 10 from the floor surface in the case of using a frequency of 953 (MHz)

FIG. 10 is a diagram illustrating an example of how the metal pipe by way of the embodiment is managed. FIG. 11 illustrates a result of simulating the relation between the antenna gain of the metal pipe 10 and the usage frequency band, corresponding to the height of the metal pipe from the floor surface in the example given in FIG. 10. FIG. 12 illustrates a result of simulating the relation between the gain of the metal pipe 10 serving as the antenna and the height of the metal pipe from the floor surface in the case of using the frequency of 953 (MHz). Note that "FREE SPACE" given in FIGS. 11 and 12 represents a characteristic in the case of disposing the metal pipe 10 in a free space which does not take the floor surface into consideration.

According to the example in FIG. 10, the metal pipe 10 is disposed in the position having a height h (mm) from a floor surface 30 so that the floor surface 30 is parallel to the longitudinal direction (the Z-axis direction in FIG. 1) of the metal pipe 10, and the slot 11 faces in the direction opposite to the floor surface 30 (in the ceiling direction).

As illustrated in FIG. 11, in the case of disposing the metal pipe given by way of the embodiment as in FIG. 10, it is feasible to obtain substantially the same gain as in the free space in the UHF band (ranging from 860 megahertz (MHz) to 960 MHz) when disposed in a position having a height of 30 (mm) or more from the floor surface 30. Further, as illustrated in FIG. 12, in the case of using the frequency band of 953 (MHz), if the height from the floor surface is equal to or larger than approximately 27 (mm), the gain equal to the gain in the free space can be acquired. Note that the frequency of 953 (MHz) is the frequency band specified in Japan as the frequency used for the wireless tag.

Accordingly, in the case of managing the metal pipe having the structure in the embodiment by the wireless tag management system, the metal pipe is fixed at the height described above from the floor surface 30 corresponding to the usage frequency band. For example, an available scheme is that the metal pipe 10 is disposed on the insulating member to thereby ensure the height from the floor surface 30 as described above.

Next, the management technique of the metal pipe will be discussed by way of the embodiment with reference to FIGS. 13 through 15 as to which positions are desirable the metal pipes are disposed in to perform the communications with the interrogator in terms of a relation between the neighboring metal pipes in the case of disposing the plurality of metal pipes adjacent to each other.

Figure 13:
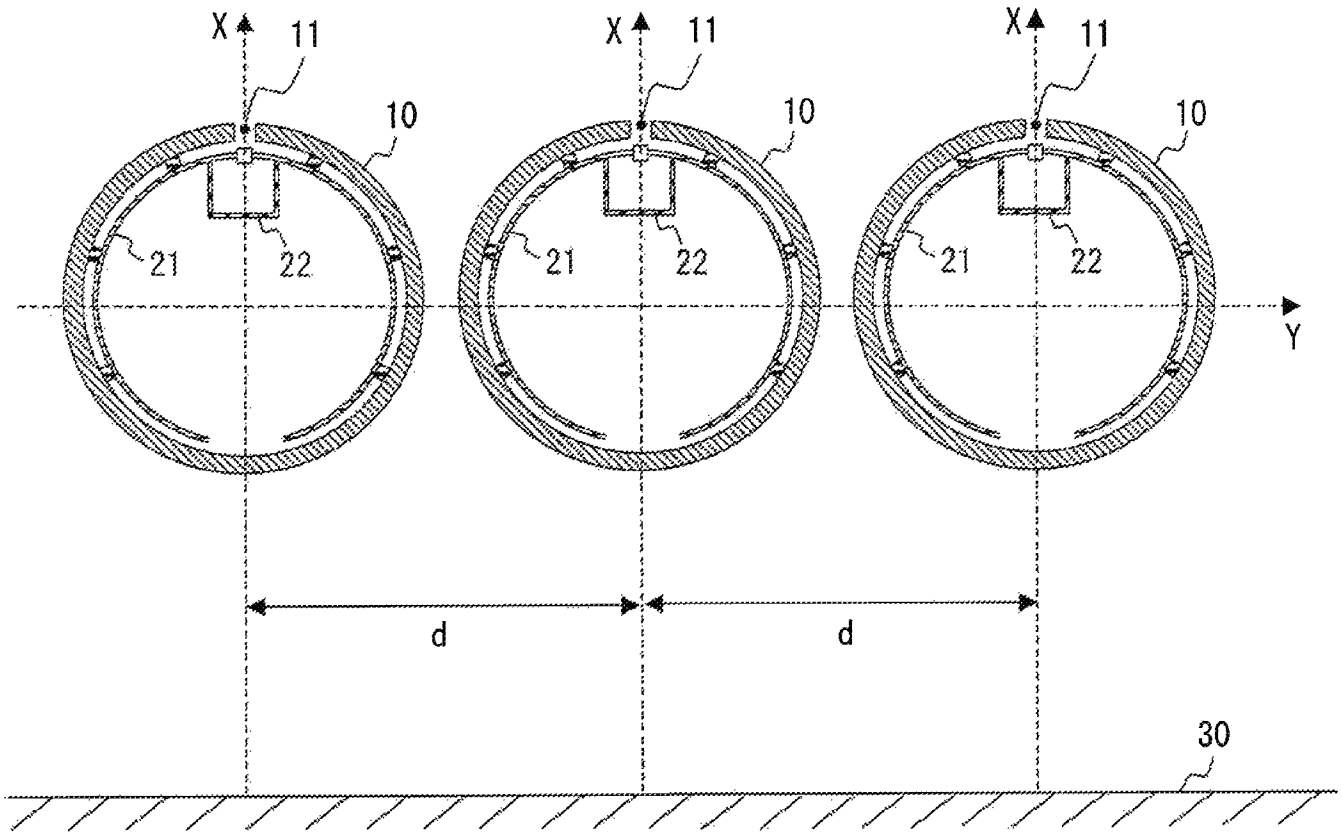
FIG. 13 is a diagram illustrating an example of a method of arranging the metal pipes by way of the embodiment.

FIG. 13 is a diagram illustrating an example of a method of arranging the metal pipes by way of the embodiment. According to the example in FIG. 13, the plurality of metal pipes disposed as in the example illustrated in FIG. 10 is arranged at a specified interval d (mm). FIG. 14 illustrates a result of simulating the relation between the antenna gain of the metal pipe 10 and the usage frequency band corresponding to the interval between the respective metal pipes 10 in the example of the arranging method of the metal pipes illustrated in FIG. 13. FIG. 15 illustrates a result of simulating the antenna gain of the metal pipe 10 corresponding to the interval between the respective metal pipes 10 in the case of using the frequency of 953 (MHz). Note that "FREE SPACE" given in FIGS. 14 and 15 represents a characteristic in the case of disposing the metal pipes 10 in the free space which does not take into consideration the floor surface and the neighboring metal pipe.

Figure 14:
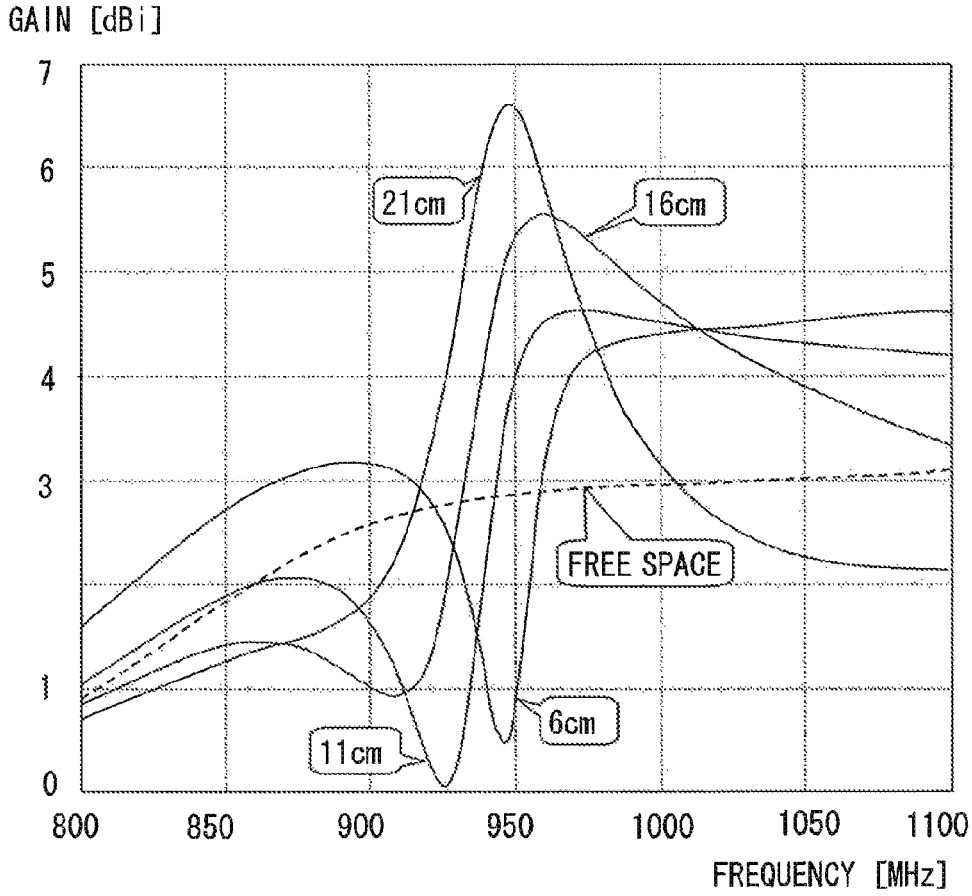
FIG. 14 illustrates a result of simulating a relation between the antenna gain of the metal pipe 10 and the usage frequency band corresponding to a distance from the neighboring metal pipe 10 in the example in FIG. 13.

As illustrated in FIG. 14, in the case of disposing the metal pipes 10 as in FIG. 13 by way of the embodiment, if managed by setting the interval between the respective metal pipes to 11 (cm) or longer when using the frequency band (in the vicinity of 950 MHz) specified in Japan, substantially the same gain as in the free space can be acquired. On the other hand, in the case of using the frequency band ranging from 860 (MHz) to 900 (MHz) in the UHF band, substantially the same gain as in the free space can be acquired when disposed at the interval of about 6 (cm) between the respective metal pipes.

Figure 15:
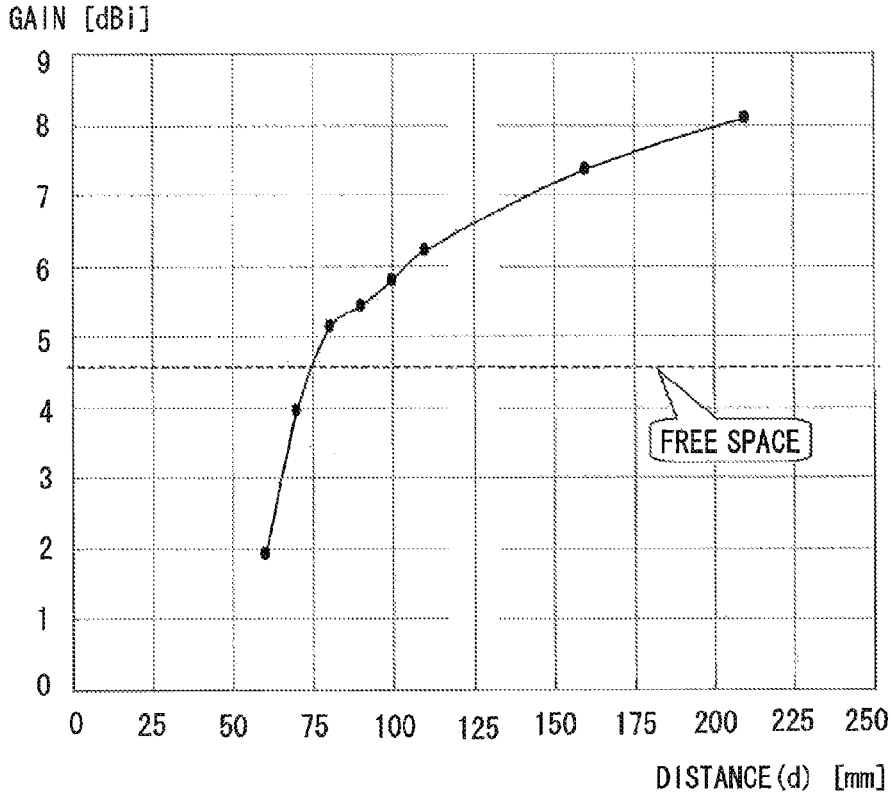
FIG. 15 illustrates a result of simulating a relation between the antenna gain of the metal pipe 10 and the distance from the neighboring metal pipe 10 in the case of using the frequency of 953 (MHz)

Moreover, as illustrated in FIG. 15, in the case of using the frequency band of 953 (MHz), the same gain as in the free space can be acquired if the interval between the respective metal pipes is equal to or larger than approximately 80 (mm).

Accordingly, in the case of managing the metal pipe having the structure in the embodiment by the wireless tag management system, the interval between the individual metal pipes 10 is fixed to have the distance described above corresponding to the usage frequency band.

MODIFIED EXAMPLE

The wireless tag attached to the metal pipe 10 in the embodiment of the present invention discussed above includes, as illustrated in FIG. 2, the C-shaped conductor pattern 21 forming the dipole and the looped conductor pattern 22 but may also be constructed of only the conductor pattern 21. This is because, as stated above, the conductor pattern 21 can function as the power feeding circuit and the matching circuit as well. In this case, the conductor pattern is configured to take the impedance matching between the metal pipe 10 serving as the antenna and the IC chip 23, corresponding to the length etc of the conductor pattern 21.

Figure 16:
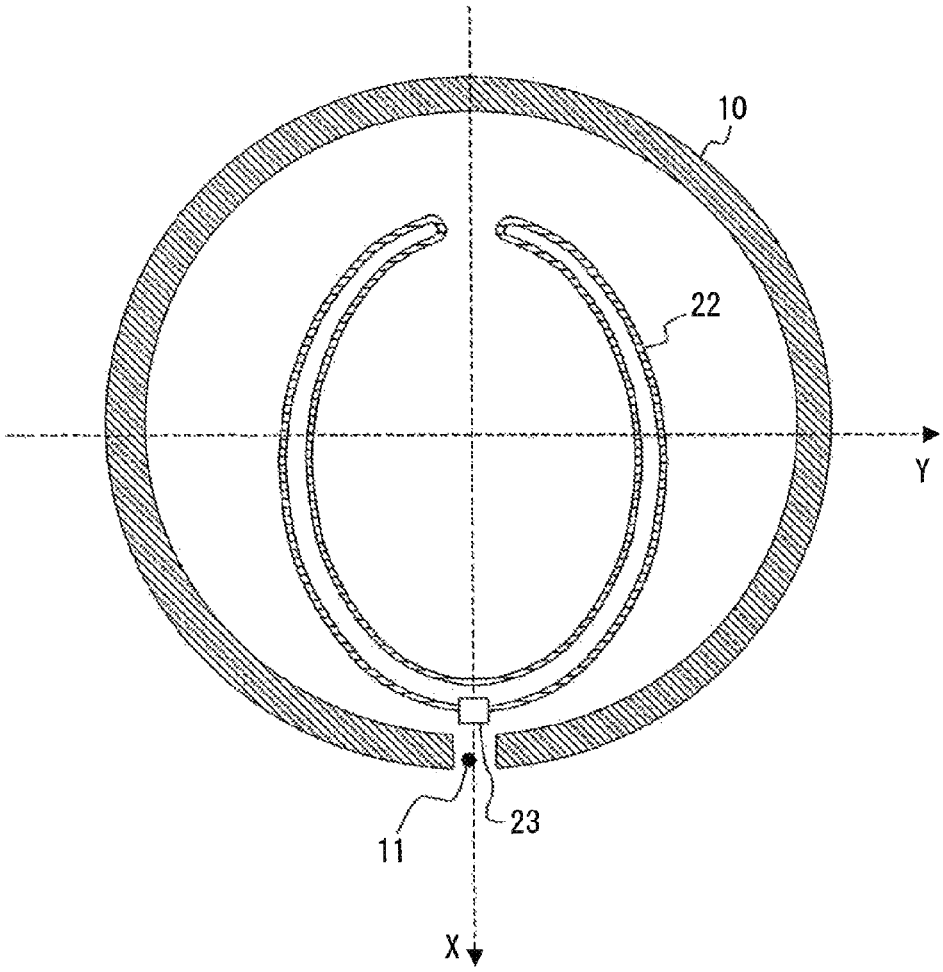
FIG. 16 is a sectional view of the metal pipe 10 as viewed from the top of the Z-axis in the case of cutting the metal pipe 10 by the X-Y plane represented in FIG. 1 as a modified example of the embodiment of the present invention.

Further, as illustrated in FIG. 16, the wireless tag may be constructed of only the looped conductor pattern 22. FIG. 16 is a sectional view, which is similar to FIG. 2, of the metal pipe 10 as a modified example of the embodiment of the present invention.

In the example of FIG. 16, the conductor pattern 22 takes, with the IC chip 23 being substantially centered, the looped shape and is formed in the C-shape on the whole. Owing to this configuration, the conductor pattern 22 forms a folded dipole and functions also as the power feeding circuit. The conductor pattern 22 functions as the coil because of being formed in the looped-shape and, as a matter of course, functions as the matching circuit as well.

Moreover, the metal pipe 10 given by way of the embodiment discussed above may also be configured so as to seal the slot 11 with the insulating member. If configured in this way, it is feasible to prevent the water drop and the dirt from permeating the interior of the metal pipe 10 from the outside and to prevent the damage to the IC chip 23 etc of the wireless tag. It is to be noted that even when adopting such a configuration, any hindrance does not occur in the antenna performance of the slot antenna.

Furthermore, another available configuration is that the whole or some portion of the wireless tag attached to the inside of the metal pipe 10 is covered with the insulating member. With this configuration, the IC chip 23 etc can be prevented from being damaged.

What is claimed is:

1. A wireless tag, comprising:

a power feeding unit to feed electric power in order for a metal pipe to function as an antenna, the power feeding unit being placed inside the metal pipe that is formed with a slot having a predetermined length in a longitudinal direction, and including conductor pattern taking an arc shape along an inner periphery of the metal pipe, the conductor pattern being isolated from the metal pipe and for feeding the electric power to the metal pipe through electromagnetic coupling;

an IC (Integrated Circuit) chip, which is placed inside the metal pipe and is connected to the power feeding unit, to allow monitoring of position of the metal pipe that is a construction material; and a matching unit including a looped conductor pattern formed in parallel with a plane orthogonal to the longitudinal direction and connected to the IC chip in parallel with the looped conductor pattern, the matching unit to take impedance matching between the metal pipe and the IC chip, wherein the frequency of the electric power is lower than the cutoff frequency of the metal pipe.

2. The wireless tag according to claim 1, wherein the power feeding unit includes a matching function of taking impedance matching between the metal pipe and the IC chip by adjusting a length of the conductor pattern.

3. The wireless tag according to claim 1, wherein the power feeding unit and the matching unit are insulated from the metal pipe.

4. A metal pipe, comprising:

a slot having a predetermined length in a longitudinal direction of the metal pipe; and a wireless tag to allow monitoring of position of the metal pipe that is a construction material, wherein the wireless tag is placed inside the metal pipe and includes a power feeding unit to feed electric power to the slot in order for the metal pipe to function as an antenna and an IC (Integrated Circuit) chip connected to the power feeding unit, the power feeding unit including conductor pattern taking an arc shape along an inner periphery of the metal pipe, the conductor pattern being isolated from the metal pipe and for feeding the electric power to the metal pipe through electromagnetic coupling, wherein the wireless tag further includes a matching unit including a looped conductor pattern formed in parallel with a plane orthogonal to the longitudinal direction and connected to the IC chip in parallel with the looped conductor pattern, the matching unit to take impedance matching between the metal pipe and the IC chip, wherein the frequency of the electric power is lower than the cutoff frequency of the metal pipe.

5. The metal pipe according to claim 4, wherein the power feeding unit includes a matching function of taking impedance matching between the metal pipe and the IC chip by adjusting a length of the conductor pattern.

6. The metal pipe according to claim 4, further comprising an insulating member to seal the slot.

7. The metal pipe according to claim 4, wherein the wireless tag is attached to the inside of the metal pipe in a state of being covered with an insulating element.

8. The metal pipe according to claim 4, wherein the length of the slot in the longitudinal direction is defined as corresponding to a gain of the wireless tag serving as the antenna.

9. The metal pipe according to claim 4, wherein a height of the slot from a floor surface is defined as corresponding to a gain of the wireless tag serving as the antenna.

10. The metal pipe according to claim 4, wherein a distance between the slot of the metal pipe itself and the slot of another metal pipe is defined as corresponding to a gain of the wireless tag serving as the antenna.

* * * * *